US009061434B2

(12) United States Patent
Yokoe

(10) Patent No.: US 9,061,434 B2
(45) Date of Patent: Jun. 23, 2015

(54) PRINTER

(75) Inventor: Asami Yokoe, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/596,334

(22) Filed: Aug. 28, 2012

(65) Prior Publication Data

US 2013/0051892 A1 Feb. 28, 2013

(30) Foreign Application Priority Data

Aug. 30, 2011 (JP) ..... 2011-187868

(51) Int. Cl.

| | |
|---|---|
| ***B41J 11/00*** | (2006.01) |
| ***B26D 7/22*** | (2006.01) |
| ***B41J 11/70*** | (2006.01) |
| ***B41J 15/04*** | (2006.01) |
| ***B26D 1/02*** | (2006.01) |

(52) U.S. Cl.

CPC . *B26D 7/22* (2013.01); *B41J 11/70* (2013.01); *B41J 15/042* (2013.01); *B26D 1/025* (2013.01)

(58) Field of Classification Search

CPC ..... B26D 7/22; B26D 1/025; B41J 11/70; B41J 15/042

USPC ..... 400/621, 693

See application file for complete search history.

(56) References Cited

U.S. PATENT DOCUMENTS

| | | | | |
|---|---|---|---|---|
| 6,899,479 | B2 * | 5/2005 | Hayashi et al. | 400/621 |
| 7,510,343 | B1 * | 3/2009 | Arrington et al. | 400/621 |
| 7,883,283 | B2 | 2/2011 | Oshida et al. | |
| 8,152,393 | B2 * | 4/2012 | Tsuchiya et al. | 400/621 |
| 8,303,200 | B2 * | 11/2012 | Yokoyama et al. | 400/621 |
| 2005/0123336 | A1 | 6/2005 | Oshida et al. | |
| 2008/0260448 | A1 * | 10/2008 | Tsuchiya et al. | 400/621 |

FOREIGN PATENT DOCUMENTS

| | | |
|---|---|---|
| CN | 1616238 | 5/2005 |
| EP | 1 038 687 | 9/2000 |
| JP | 2000 052291 | 2/2000 |
| JP | 2002 144657 | 5/2002 |
| JP | 2005-161832 A | 6/2005 |
| WO | 2010/056987 | 5/2010 |

OTHER PUBLICATIONS

European Search Report Issued in EP Application No. EP 12180741 on Dec. 4, 2012.

Chinese Office Action issued in Application No. 201210312458.1 on Apr. 1, 2014.

Chinese Office Action issued in Application No. 201210312458.1 on Oct. 30, 2014.

* cited by examiner

*Primary Examiner* — Matthew G Marini

(74) *Attorney, Agent, or Firm* — McCarter & English, LLP

(57) ABSTRACT

The disclosure discloses a printer comprising: a fixed part and an opening/closing part; a feeding roller configured to feed the print-receiving medium; a print head; a discharging exit configured to discharge the print-receiving medium; a fixed blade fixed to the fixed part so as to follow along an edge part of the discharging exit; a fixed blade cover; and a support device configured to support in a relatively displaceable manner the print head and the fixed blade cover, forming a first state wherein the fixed blade cover covers the blade edge of the fixed blade and the print head separates from the feeding roller when the opening/closing part changes to an open state, and a second state wherein the fixed blade cover does not cover the blade edge of the fixed blade and the print head presses against the feeding roller when the opening/closing part changes to a closed state.

4 Claims, 8 Drawing Sheets

PRINTER

CROSS-REFERENCE TO RELATED APPLICATION

The present application claims priority from Japanese Patent Application No. 2011-187868, which was filed on Aug. 30, 2011, the disclosure of which is incorporated herein by reference in its entirety.

BACKGROUND

1. Field

The present disclosure relates to a printer configured to perform desired printing on a print-receiving medium.

2. Description of the Related Art

There are known printers that perform desired printing on and subsequently cut a print-receiving medium to generate a printed matter. In such a printer are provided a storage part, a feeding roller (paper feeding roller), and print head. The print-receiving medium (rolled paper) supplied from a roll stored in the storage part is fed by the feeding roller, and desired printing is performed by the print head on the that fed print-receiving medium. The print-receiving medium after printing is discharged from a discharging exit of the housing to the outside. An operator can cut the discharged print-receiving medium using a cutting blade (cutter). Further, the housing is equipped with an opening/closing part (opening/closing lid) capable of opening and closing the storage part, making it possible for the operator to easily perform work by opening the opening/closing part when storing or replacing the roll in the storage part.

At this time, the internal structure of the housing is exposed by opening the opening/closing part, resulting in the possibility that the operator may mistakenly touch the cutting blade during the above described work. Here, according to the printer of this prior art, the cutting blade is capable of moving in conjunction with the open state and closed state of the opening/closing part. That is, the cutting blade moves from the cutting position to the storage position when the opening/closing part changes to an open state, and from the storage position to the cutting position when the opening/closing part changes to a closed state. With this arrangement, use of the cutting blade is not inhibited when the opening/closing part is closed and a printing operation is performed, and the cutting blade is not exposed toward the operator when the opening/closing part is open, thereby increasing the safety of the operator.

Nevertheless, in the above described prior art, because the structure is designed so that the blade moves in association with the opening and closing of the opening/closing part as described above, the problem arises that the rigidity of the support structure of the blade decreases, decreasing the positioning accuracy of the blade.

SUMMARY

It is therefore an object of the present disclosure to provide a printer capable of ensuring the safety of the operator with respect to the blade, without rendering a decrease in rigidity or positioning accuracy, even when the opening/closing part is open.

In order to achieve the above-described object, according to the aspect, there is provided a printer comprising: a housing configured to constitute a printer contour and configured to comprise a fixed part and an opening/closing part that is openably and closeably connected to the fixed part; a storage part configured to store a roll around which is wound a print-receiving medium and is open and close by the opening/closing part; a feeding roller configured to feed the print-receiving medium supplied from the roll stored in the storage part; a print head configured to perform desired printing on the print-receiving medium fed by the feeding roller; a discharging exit configured to discharge the print-receiving medium on which printing was performed by the print head to outside the housing; a fixed blade configured to cut the print-receiving medium discharged from the discharging exit, fixed to the fixed part so as to follow along an edge part of the discharging exit; a fixed blade cover configured to cover a blade edge of the fixed blade, integrally provided with the print head; and a support device configured to support in a relatively displaceable manner the print head and the fixed blade cover with respect to the fixed part, forming a first state wherein the fixed blade cover covers the blade edge of the fixed blade and the print head separates from the feeding roller when the opening/closing part changes to an open state, and a second state wherein the fixed blade cover does not cover the blade edge of the fixed blade and the print head presses against the feeding roller when the opening/closing part changes to a closed state.

In the printer of the aspect of the present disclosure, a storage part, feeding roller, and print head are provided. The print-receiving medium supplied from a roll stored in the storage part is fed by the feeding roller, and desired printing is performed by the print head on that fed print-receiving medium. The print-receiving medium after printing is discharged from a discharging exit of the housing to the outside. The operator can cut the discharged print-receiving medium using a fixed blade fixed so that it follows the edge part of the discharging exit.

Further, according to the present disclosure, a fixed blade cover capable of covering the blade edge of the fixed blade in conjunction with the open state and closed state of the opening/closing part is provided. At that time, the fixed blade cover is integrally provided to the print head which moves toward and away from the feeding roller in conjunction with the open state and closed state of the opening/closing part, making it possible to perform the opening/closing operation of the opening/closing part and the movement of the fixed blade cover and the print head together in coordination.

That is, the print head and fixed blade cover are supported in a relatively displaceable manner with respect to the fixed part by support means, switching between a first state and a second state in accordance with the opening and closing of the opening/closing part. The fixed blade cover does not cover the blade edge of the fixed blade in the second stage in which the opening/closing part is closed, and covers the blade edge of the fixed blade in the first state in which the opening/closing part is open.

As described above, in this present disclosure, it is possible to not inhibit use of the fixed blade when the opening/closing part is closed and the printing operation is performed, and cover and not expose the blade edge of the fixed blade when the opening/closing part is open. Accordingly, it is possible to increase the safety of the operator when the opening/closing part is open.

Further, at this time, because the structure is designed so that the fixed blade cover moves while the fixed blade is fixed as is as described above, the rigidity of the support structure of the blade can be increased and the positioning accuracy of the blade can be improved compared to the prior art in which the blade moves.

DETAILED DESCRIPTION OF THE PREFERRED EMBODIMENTS

The following describes one embodiment of the present disclosure with reference to accompanying drawings.

General Configuration of Printer

Figure 1:
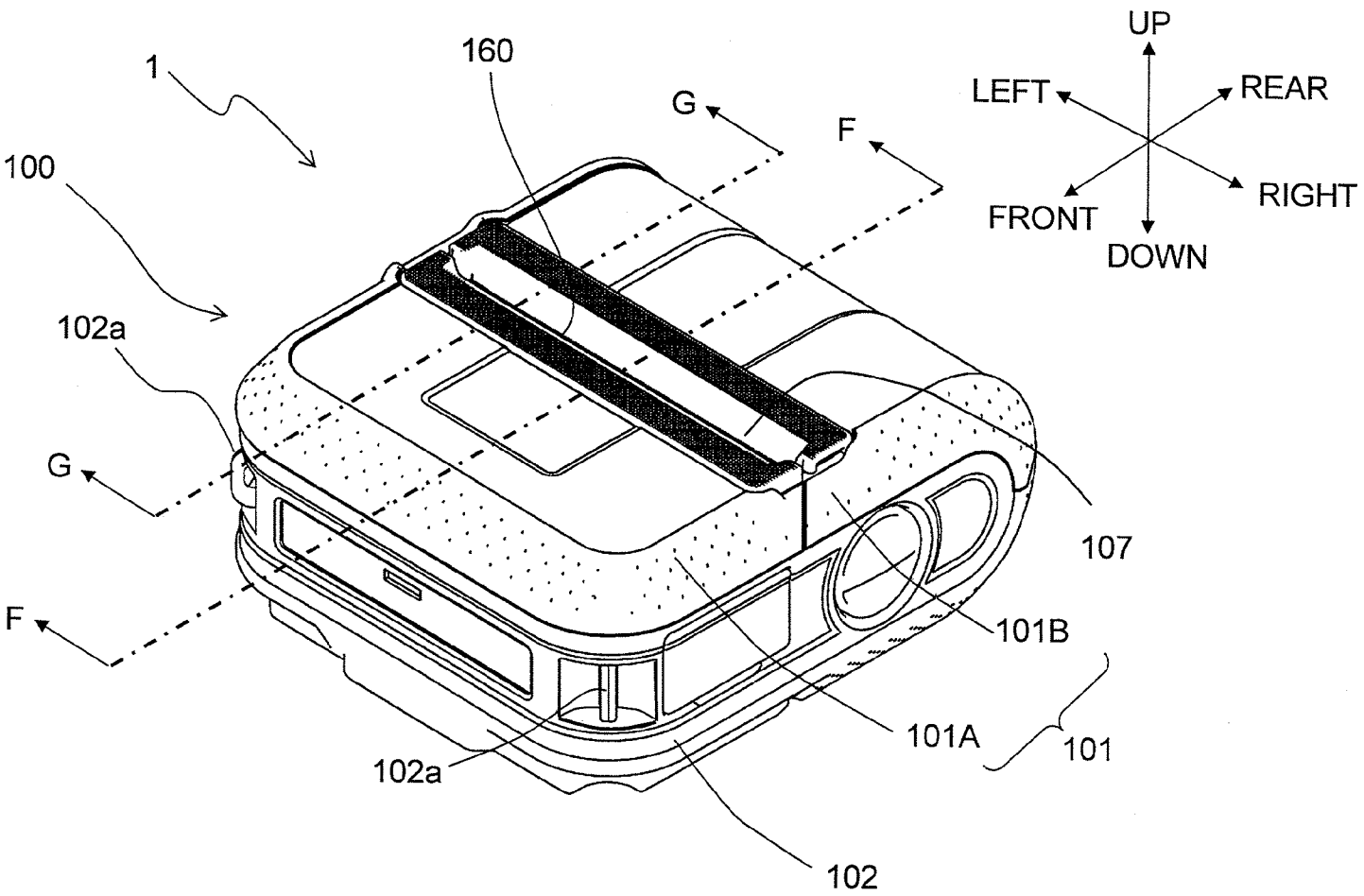
FIG. 1 is a perspective view showing the outer appearance configuration of a printer of an embodiment of the present disclosure.

The following describes the overall configuration of a printer 1, which is one embodiment of the present disclosure, using FIG. 1 to FIG. 4. In the description, the lower right direction, upper left direction, upper right direction, lower left direction, upper direction, and lower direction in FIG. 1 are defined as the right, left, rear, front, up, and down directions, respectively (refer to the arrows of each figure).

The printer 1 prints print data received from an external device (not shown) such as a PC terminal, cellular telephone, or the like onto a rolled paper S, for example. This printer 1 can be driven using a battery (not shown) as a power source.

The printer 1 comprises a substantially box-shaped printer housing 100 which constitutes the printer contour and is made of a resin material, for example. This printer housing 100 comprises a top cover 101 that constitutes the upper part of the printer contour, and an undercover 102 that constitutes the lower part of the printer contour. The top cover 101 comprises both a fixed cover part 101A on the front side, and an opening/closing part 101B on the rear side.

The end part of the undercover 102 is equipped with a pair of left and right insertion parts 102*a*. A strap, etc., is inserted through these insertion parts 102*a* and suspended around a shoulder, neck, waist belt, or the like, for example, making it possible for the operator to readily carry and use the printer 1, which is driven by a battery as described above, in various locations (including outdoors).

A roll storage part 161 is provided below the opening/closing part 101B of the top cover 101 (in the interior of the housing 100; refer to FIGS. 2 to 4). The rolled paper S is rotatably axially supported by a support member 162 at both ends and stored in this roll storage part 161, resulting in a configuration that is capable of continually supplying the rolled paper S from the roll storage part 161. At this time, the opening/closing part 101B is rotatably connected to a rear end part of the undercover 102 via a hinge H, making it possible to switch between an open state in which the roll storage part 161 is exposed to the outside (refer to FIG. 12 as well described later), and a closed state in which the roll storage part 161 is stored internally (refer to FIG. 9 as well described later). With the opening/closing part 101B set to an open state, the roll storage part 161 is exposed to the outside of the printer, making easy insertion and replacement of the rolled paper S possible.

Figure 4A:
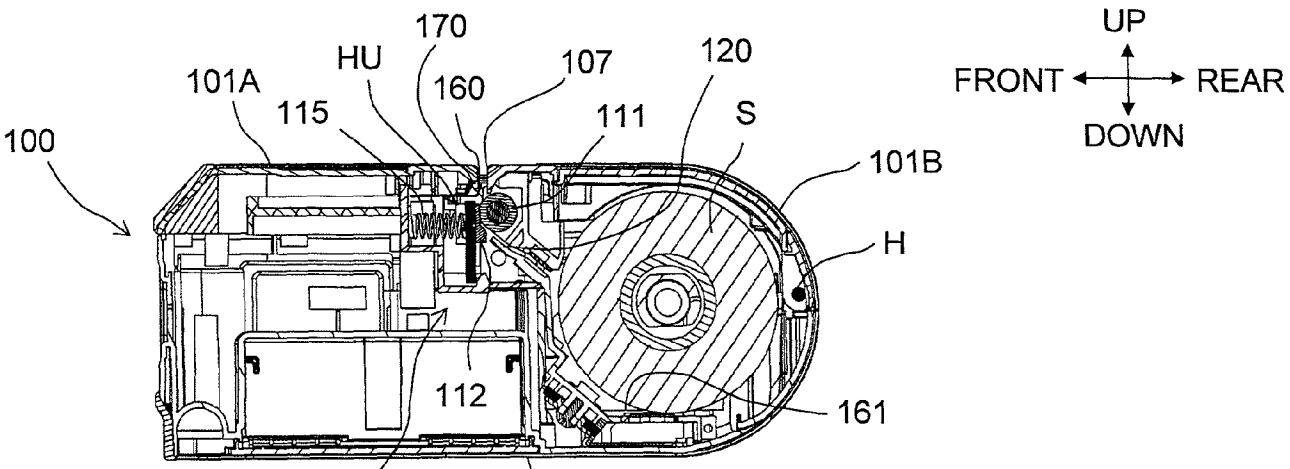
FIG. 4 shows cross-sectional views along lines F-F and G-G in FIG. 1.
Figure 4B:
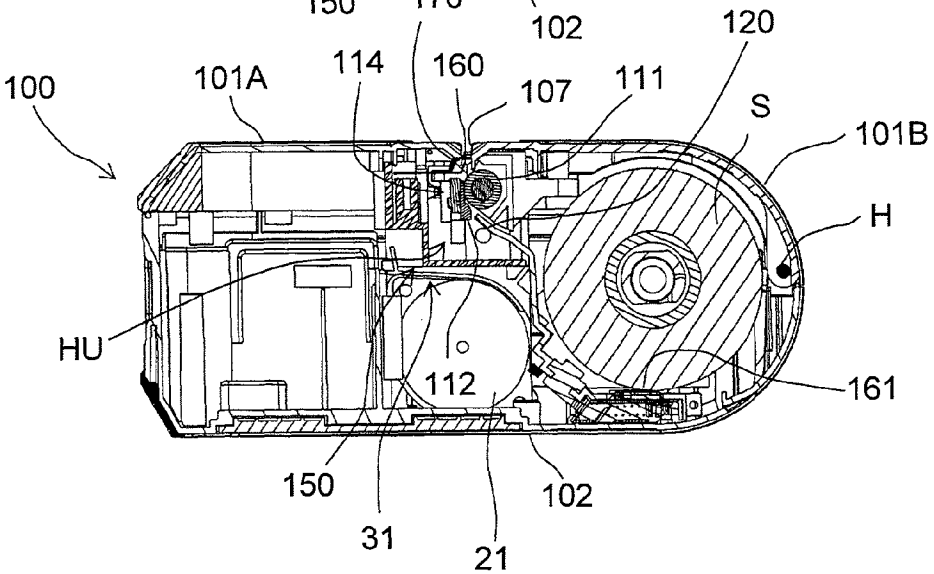

Further, a discharging exit 107 for discharging the rolled paper S after printing is provided to the substantial center of the top cover 101 in the front-rear direction (the section where the fixed cover part 101A and the opening/closing part 101B meet according to this example; refer to FIG. 1, FIG. 4, etc.). At this time, one side (the front side according to this example) of the outer edge part of the discharging exit 107 is provided to the fixed cover part 101A of the housing 100, while the other side (the rear side according to this example) is provided to the opening/closing part 101B of the housing 100. In other words, the discharging exit 107 is provided so that it is formed astride the fixed cover part 101A and the opening/closing part 101B, and opens toward one side (upward according to this example) along the vertical direction.

A platen roller 111 is rotatably supported on the front end part of the opening/closing part 101B. The platen roller 111 feeds the rolled paper S by transmitting the rotation of a rotator (not shown) within a motor casing 21 (refer to FIG. 4B) when the opening/closing part 101B is in the above described closed state.

General Configuration of Main Chassis Member 150

Figure 5:
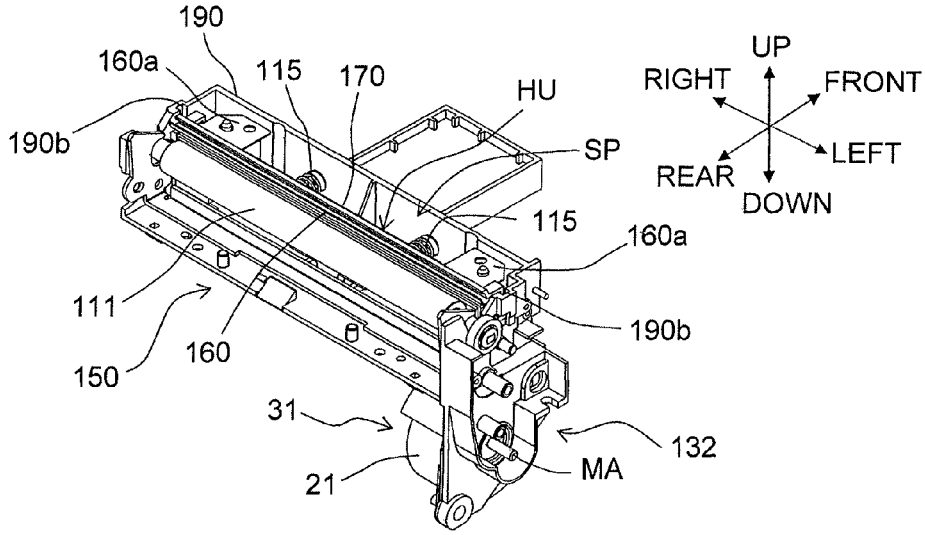
FIG. 5 is a perspective view of the main chassis member wherein the fixed blade and fixed blade cover are installed to the head unit.
Figure 6:
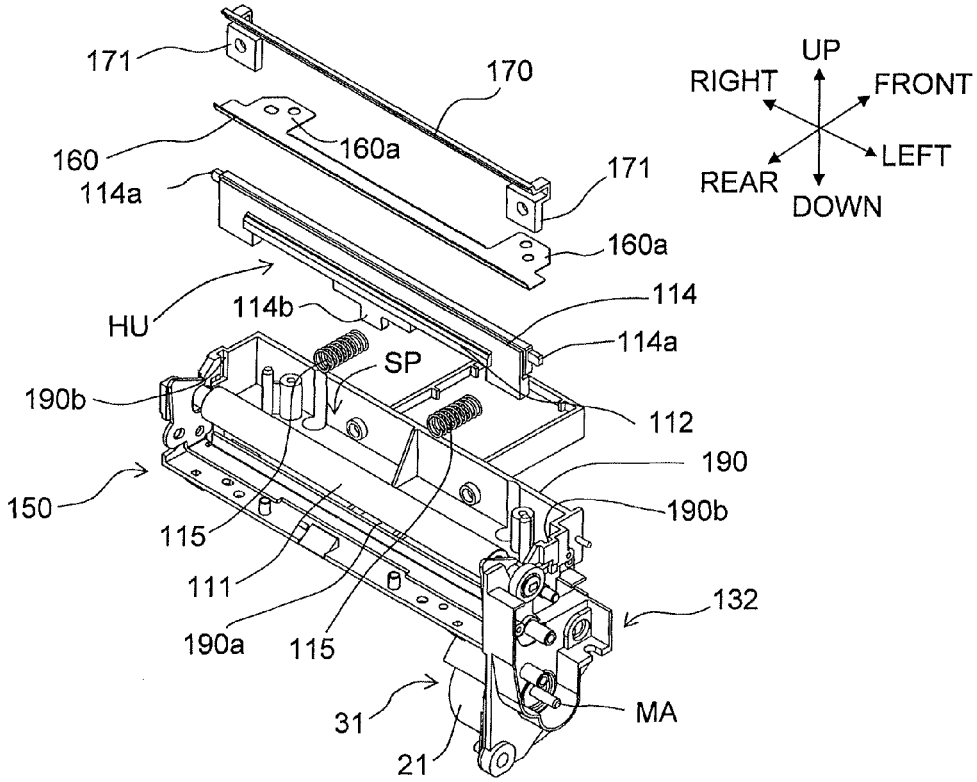
FIG. 6 is an exploded perspective view showing an exploded state of the head unit, fixed blade, and fixed blade cover.

On the other hand, a main chassis member 150 is provided near the center of the interior (specifically, the undercover 102) of the printer housing 100 in the front-rear direction. FIG. 5 and FIG. 6 show the details of the main chassis member 150 and the peripheral structure thereof. As shown in FIGS. 5 and 6 as well as the above described FIG. 4, etc., a head unit HU is rockably disposed in the front-rear direction in this main chassis member 150. The head unit HU is integrally equipment with a thermal line head 112 and a heat sink 114 for cooling the generated heat in this thermal line head 112.

Further, as shown in FIG. 5 and FIG. 6, the head unit HU is arranged in a unit housing 190 formed by a rectangular housing-shaped support frame with an open rear end surface that comprises a part of the main chassis member 150. That is, a rocking space SP is provided inside the unit housing 190, and the front end part of the heat sink 114 of the head unit HU is energized toward the above described platen roller 111 side (that is, the rear side) by a plurality of (two according to this example) coil springs 115 supported by the main chassis member 150. With this arrangement, the head unit HU is capable of rocking toward and away from the platen roller 111 (disposed on the open rear end surface side of the unit housing 190) of the closed state of the opening/closing part 101B via the above described coil springs 115 in the rocking space SP, and the thermal line head 112 contacts the platen roller 111 using a predetermined pressing force.

As a result, because the rolled paper S is inserted between the platen roller 111 and the thermal line head 112 while the thermal line head 112 (the head unit HU) presses against the platen roller 111 provided to the opening/closing part 101B of the above described closed state using optimum pressure, printing is performed smoothly and with favorable quality.

Further, the substantially cylindrical motor casing 21 that forms the contour of the motor that generates driving power for rotationally driving the platen roller 111, and a gear mechanism 132 comprising a plurality of gears and configured to transmit the driving power of the above described motor to the platen roller 111 by being operatively connected to the platen roller 111 with the opening/closing part 101B in a closed state, are provided to the left side of the main chassis member 150 as shown in FIG. 5 and FIG. 6.

The motor casing 21 is provided below the above described discharging exit 107 in the interior of the printer housing 100. The left-right direction of the motor casing 21 is established as the axial direction thereof, and a motor axis MA of the drive motor is provided protruding from the motor casing 21 to the left. Further, a motor cover 31 that covers the above described motor casing 21 is provided.

General Operation of Printer

With the above described configuration, print data is sent to the printer 1 via wireless communication (or wired or infrared communication) from an external device such as a PC terminal or cellular telephone at the time of printing. Further, the rolled paper S is fed out from the roll storage part 161 by the rotation of the platen roller 111 based on the driving power of the above described drive motor. The fed out rolled paper S is guided to a pressing part of the platen roller 111 and the thermal line head 112 by a guide member 120 provided below the discharging exit 107. Then, the thermal line head 112 performs printing in a desired form based on the above described print data onto the rolled paper S inserted between the thermal line head 112 and the platen roller 111. The rolled paper S after printing is discharged from the discharging exit 107 that extends along the left-right direction to outside the printer housing 100. At this time, a fixed blade 160 is installed to the main chassis member 150 by a screw via a horizontal support part 160*a* (refer to FIGS. 5, 6, 2, 3, etc.) at both ends of the fixed blade 160 so that it follows along the edge part of and inside the discharging exit 107. Upon completion of the printing as described above, the operator can manually cut the end part of the rolled paper S discharged from the discharging exit 107 using this fixed blade 160.

Note that, in a case where a paper jam or the like occurs during printing, the platen roller 111 is released from the thermal line head 112 by opening the above described opening/closing part 101B of the top cover 101, making it possible to easily pull out the rolled paper S.

Special Characteristics of This Embodiment

In the basic configuration above, the special characteristic of this embodiment lies in the structure wherein the movable fixed blade cover 170 is provided so that it covers the fixed blade 160. In the following, details on the functions will be described in order.

As previously described, the housing 100 of the printer 1 of this embodiment is equipped with the opening/closing part 101B capable of opening and closing the roll storage part 161, making it possible for the operator to easily perform work by opening the opening/closing part 101B when storing the rolled paper S into the roll storage part 161 or replacing the rolled paper S of the roll storage part 161. Nevertheless, opening the opening/closing part 101B exposes the internal structure of the housing 100, resulting in the possibility that the operator will mistakenly touch the blade edge of the fixed blade 160 during the above described work, resulting in injury.

Figure 2:
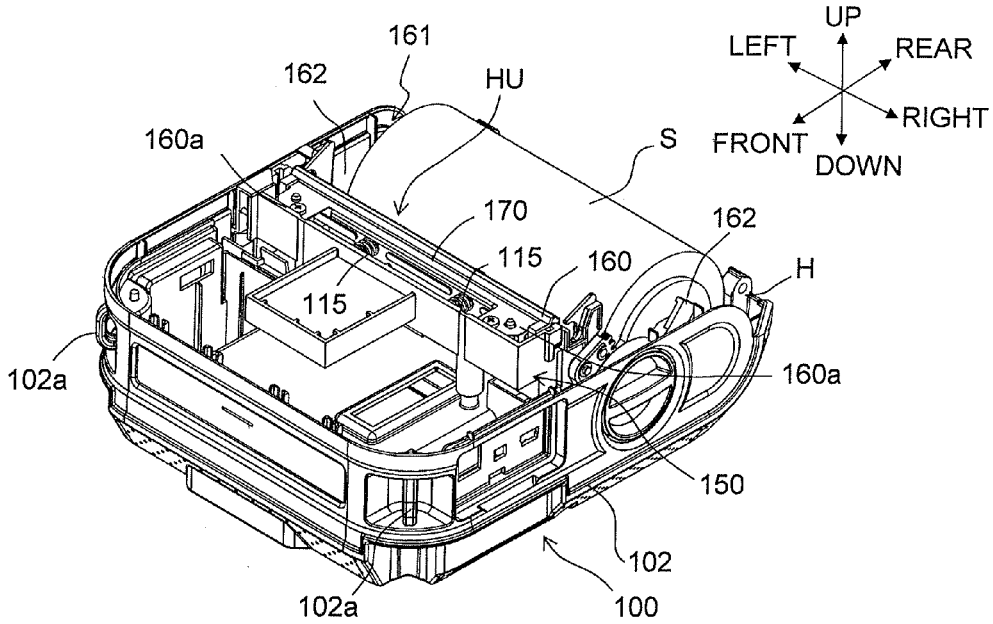
FIG. 2 is a perspective view showing a state in which the top cover of the housing is removed, as viewed from a front oblique angle from above.
Figure 3:
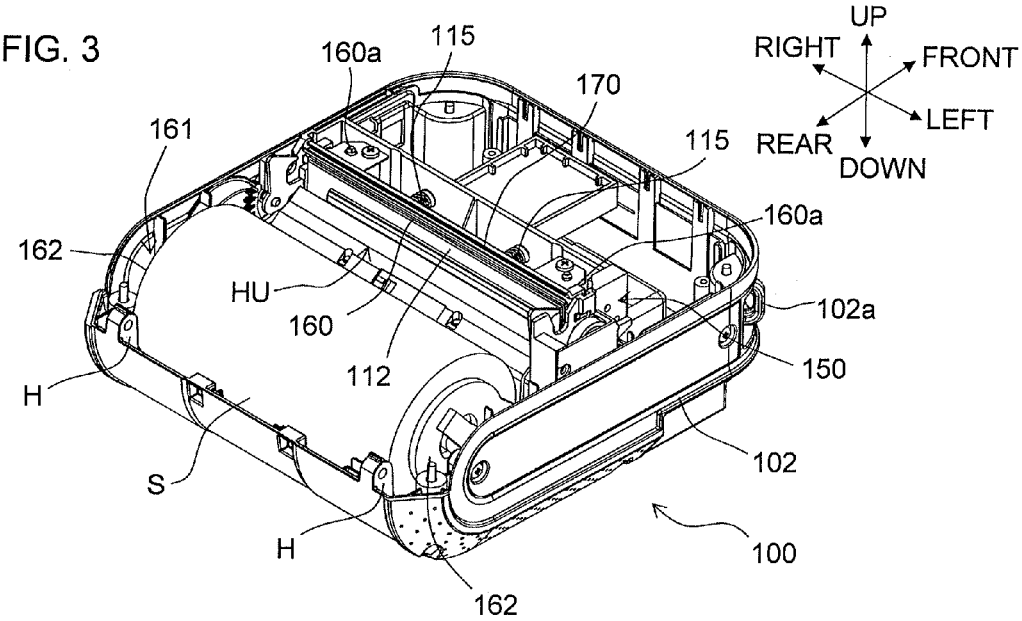
FIG. 3 is a perspective view showing a state in which the top cover of the housing is removed, as viewed from a rear oblique angle from above.

Here, according to this embodiment, the fixed blade cover 170 is installed to the above described head unit HU so that it is integrally formed with the thermal line head 112, as shown in FIGS. 2, 3, and 4. At this time, specifically, the fixed blade cover 170 is provided so that it follows along the fixed cover part 101A side (front side) section of the outer edge part of the discharging exit 107 formed astride the fixed cover part 101A and the opening/closing part 101B as described above. Then, the fixed blade cover 170 exposes or conceals the blade edge of the fixed blade 160 by being rocked toward the front and rear in conjunction with the pressing or release of the head unit HU by the platen roller 111 associated with the opening and closing of the opening/closing part 101B.

Details of Rocking of Head Unit

Figure 7A:
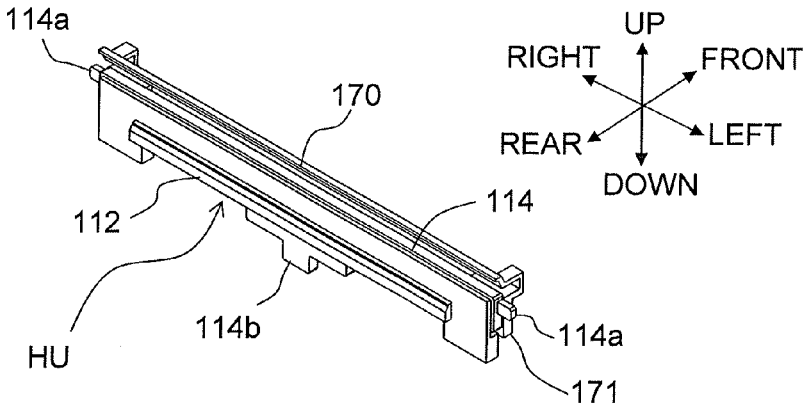
FIG. 7 is perspective views showing the overall structure of the head unit wherein the fixed blade cover is installed, as viewed from rear and front oblique angles from above, respectively.
Figure 7B:
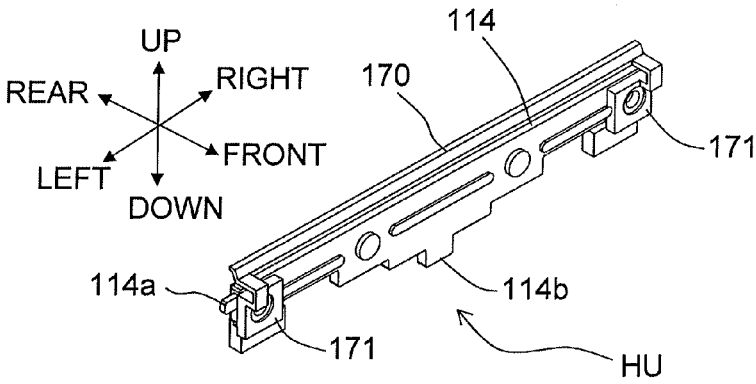
Figure 8A:
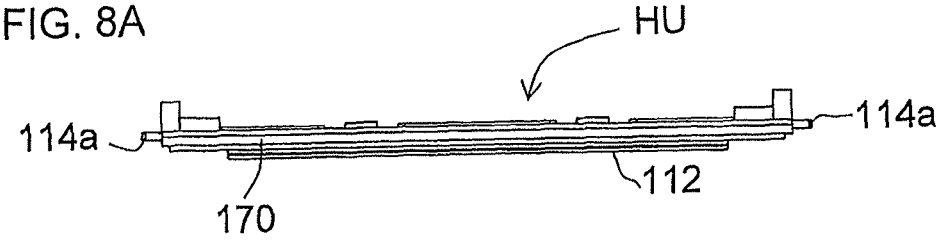
FIG. 8 is a planar view, front view, side view, and cross-sectional view along line A-A showing the detailed structure of the head unit wherein the fixed blade cover is installed.
Figure 8B:
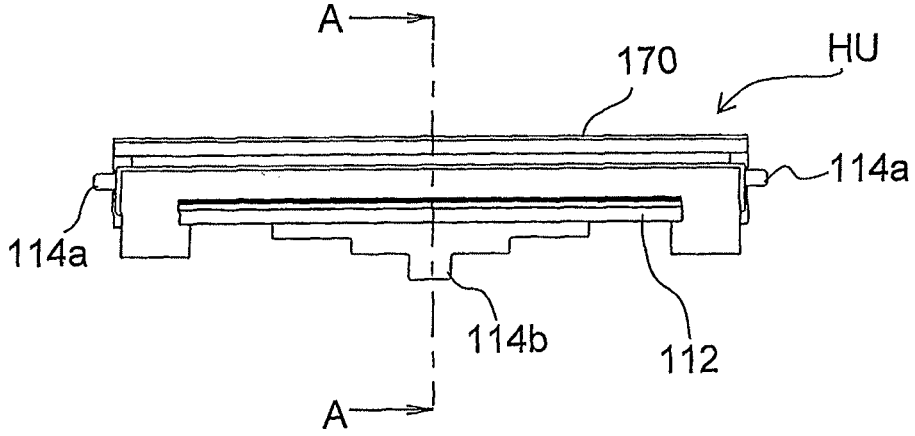
Figure 8C:
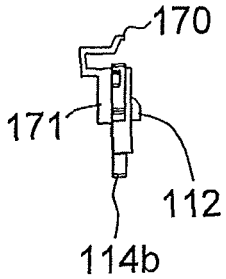
Figure 8D:
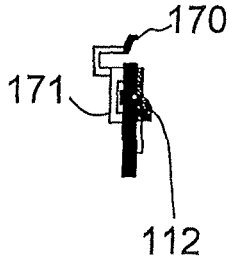

That is, in the head unit HU, the thermal line head 112 is attached to the inside of one surface of the rectangular plate-shaped heat sink 114 having a long lateral length, along the longitudinal direction (that is, the left-right direction), as shown in the above described FIG. 6 as well as FIGS. 7 and 8. Further, the section of the heat sink 114 that is below the position of the thermal line head 112 is cut out. Then, a rectangular-shaped protruding part 114*b* is provided in an extended manner to the center of this cut out section. Then, the protruding part 114*b* is inserted into an insertion hole 190*a* provided in a concave manner along the front-rear direction on the inner bottom side of the above described unit housing 190 of the main chassis member 150 so that it is movable in the front-rear direction.

Further, a rectangular protruding shaped ear part 114*a* is provided in an extended manner to the upper part of both left and right sides of the heat sink 114, and conversely a groove part 190*b* indented from the upper edge into a substantial L shape is provided in a concave manner to the left and right inner wall surfaces of the above described unit housing 190 of the main chassis member 150. The ear part 114*a* of this groove part 190*b* is inserted so that it is movable in the front-rear direction along the L-shaped lower end of the groove part 190*b*. The rocking of the head unit HU within the rocking space SP previously described is achieved due to the engagement of this ear part 114*a* and the groove part 190*b* and the engagement of the above described protruding part 114*b* and the insertion hole 190*a*.

Details of the Fixed Blade Cover

Then, the fixed blade cover 170 is installed to the head unit HU that rocks within the rocking space SP as described above. The fixed blade cover 170 is formed by a long plate member bent into a substantially upside down V cross-sectional shape, as shown in FIGS. 6, 7, and 8. Further, an installation part 171, which is first bent into a leftward U shape and then formed into a vertical piece shape, is formed on both end parts of the fixed blade cover 170. This installation part 171 is fixed by a screw, etc. (not shown), to the heat sink 114 so that the above described horizontal support part 160*a* at both ends of the fixed blade 160 fixed inside the discharging exit 107 is inserted therein.

Operation of the Fixed Blade Cover

Figure 9:
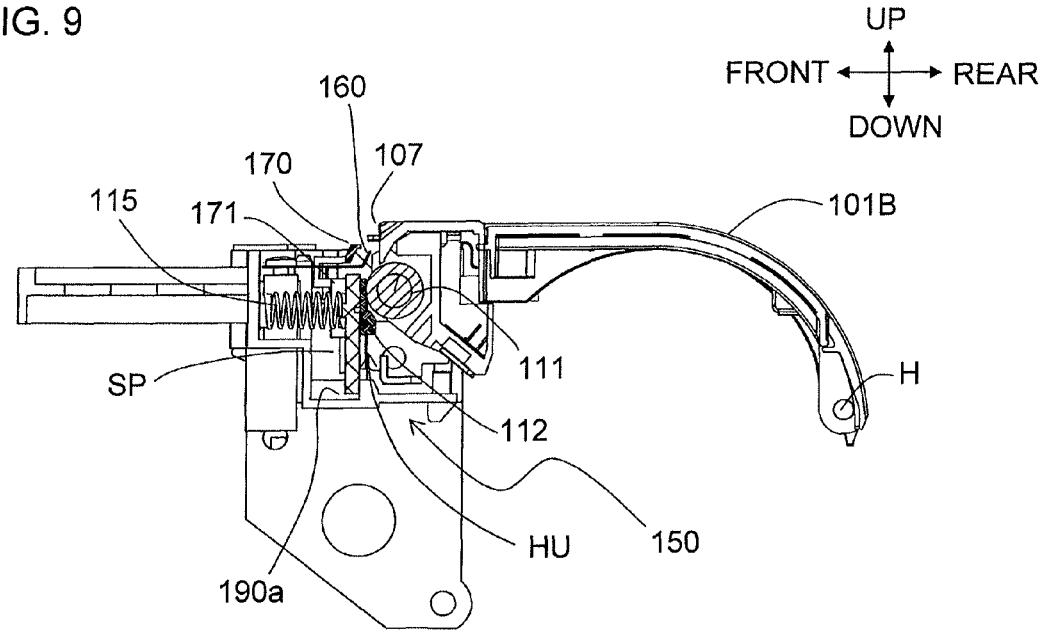
FIG. 9 is a cross-sectional view showing the state (second state) immediately before the opening/closing part is opened.

Next, the operation of the fixed blade cover 170 configured as described above will be described using FIG. 9 to FIG. 12. First, as shown in FIG. 9, when the opening/closing part 101B is closed and the thermal line head 112 is pressed by the platen roller 111, the head unit HU resists the energizing force of the coil springs 115 and moves inside the rocking space SP toward the front. As a result, the distance between the front section of the unit housing 190 and the head unit HU decreases, causing the fixed blade cover 170 installed to the head unit HU to separate from the fixed blade 160 fixed to the front section of the unit housing 190, moving toward the front side as described above. With this arrangement, the fixed blade cover 170 changes to a state in which it does not cover the blade edge of the fixed blade 160 (second state).

Figure 10:
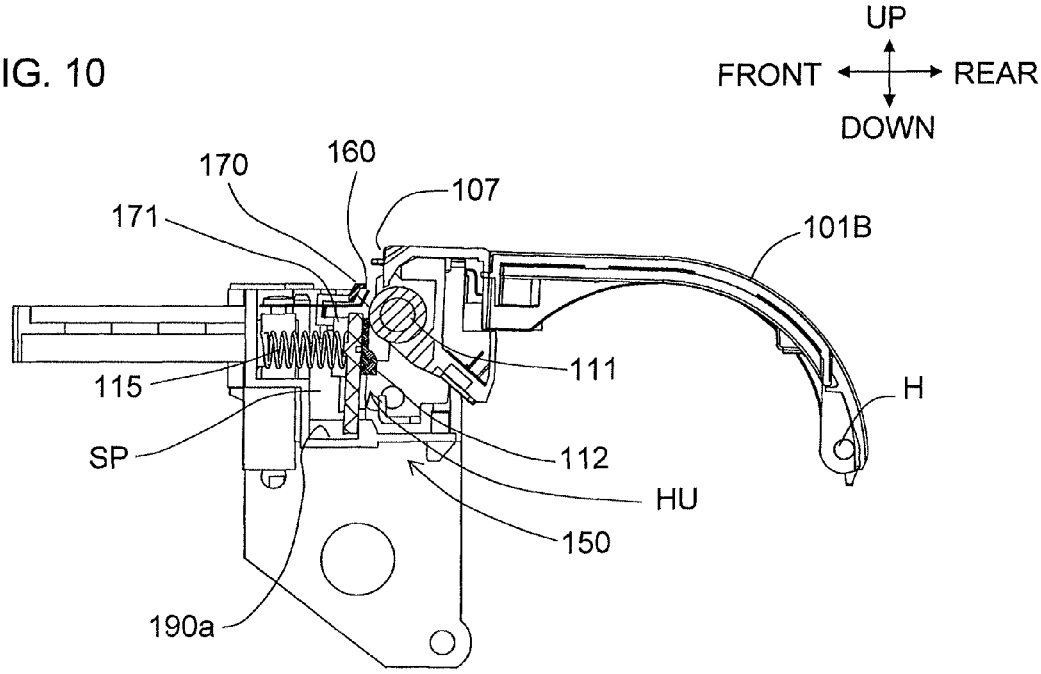
FIG. 10 is a cross-sectional view showing the state in which the opening/closing part is slightly open.
Figure 11:
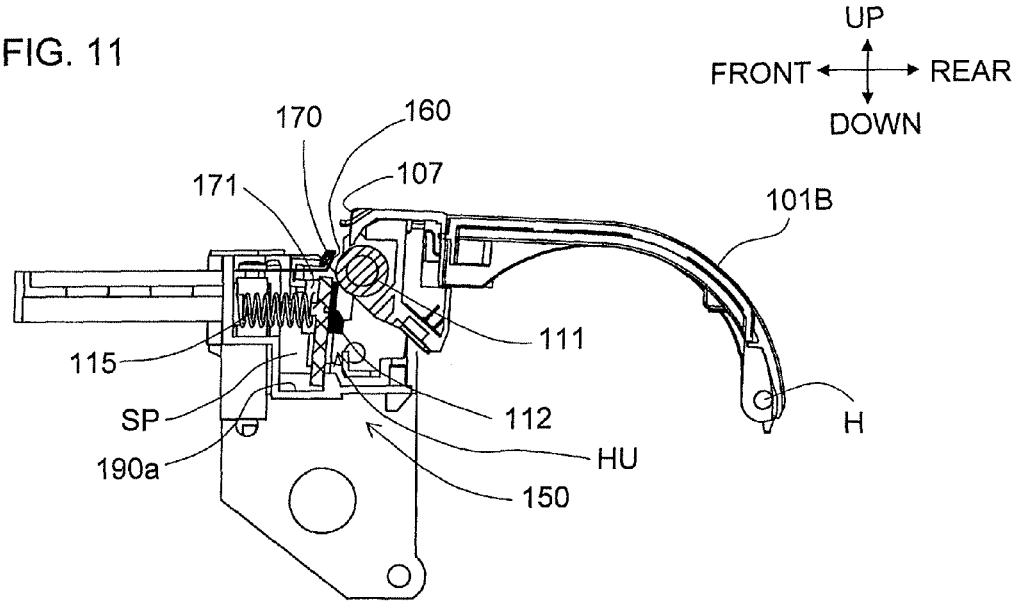
FIG. 11 is a cross-sectional view showing the state (first state) in which the opening/closing part is opened to release the pressing of the thermal line head by the platen roller, and the blade edge of the fixed blade is covered by the fixed blade cover.
Figure 12:
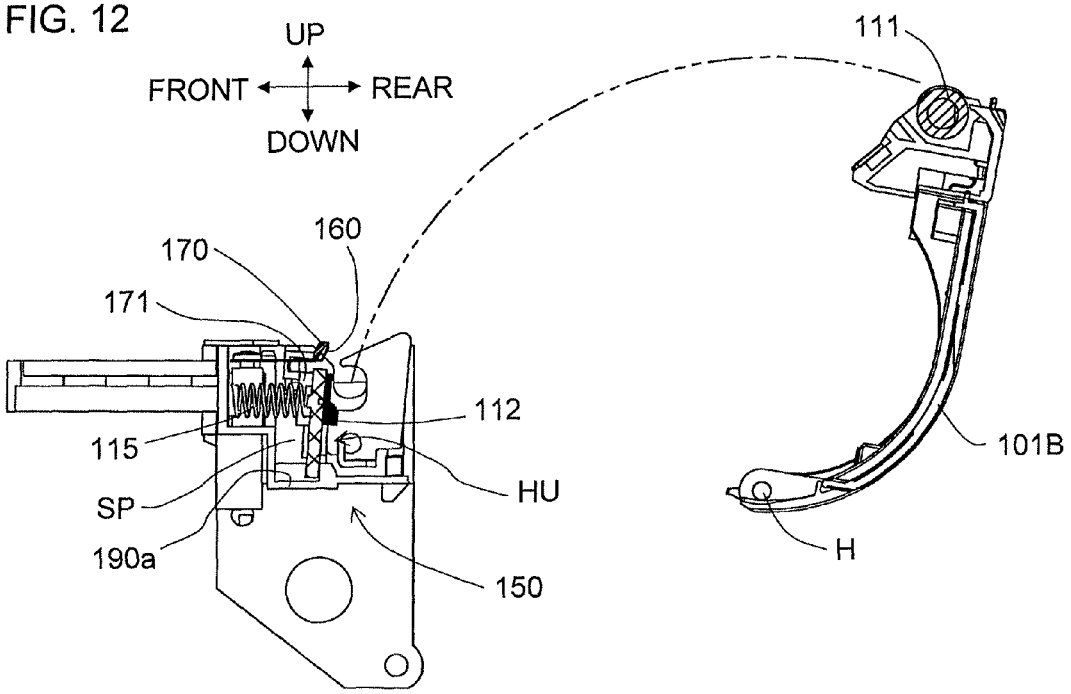
FIG. 12 is a cross-sectional view showing the state in which the opening/closing part is completely open.

On the other hand, when the above described opening/closing part 101B opens from its closed state as shown in FIG. 10 to FIG. 12, the pressing on the above described thermal line head 112 by the platen roller 111 is released, moving the head unit HU within the rocking space SP to the rear side by the energizing force of the coil springs 115. As a result, the distance between the front section of the unit housing 190 and the head unit HU increases, moving the fixed blade cover 170 installed to the head unit HU to the rear side toward the fixing blade 160. With this arrangement, the fixed blade cover 170 changes to a state in which it covers the blade edge of the fixed blade 160 (first state). In particular, as shown in FIG. 12, in the state in which the opening/closing part 101B is completely open, the fixed blade cover 170 can completely cover the blade edge of the fixed blade 160.

As described above, in the printer 1 of this embodiment, the fixed blade cover 170 capable of covering the blade edge of the fixed blade 160 in conjunction with the open state and closed state of the opening/closing part 101B is provided. At that time, the fixed blade cover 170 is integrally provided to the head unit HU which moves toward and away from the platen roller 111 in conjunction with the open state and closed state of the opening/closing part 101B, making it possible to perform the opening and closing operation of the opening/closing part 101B and the movement of the fixed blade cover 170 together in coordination. That is, in correspondence with the opening and closing of the opening/closing part 101B, the fixed blade cover 170 does not cover the blade edge of the fixed blade 160 in the second state in which the opening/closing part 101B is closed, and covers the blade edge of the fixed blade 160 in the first state in which the opening/closing part 101B is open. With this arrangement, it is possible to not inhibit use of the fixed blade 160 when the opening/closing part 101B is closed and a printing operation is performed, and cover and not expose the blade edge of the fixed blade 160 when the opening/closing part 101B is open. Accordingly, it is possible to increase the safety of the operator when the opening/closing part 101B is open. Further, at this time, because the structure is designed so that the fixed blade cover 170 moves while the fixed blade 160 is fixed as is as described above, the rigidity of the support structure of the fixed blade 160 can be increased and the positioning accuracy of the fixed blade 160 can be improved compared to the prior art in which the blade moves.

Further, in particular, according to this embodiment, the fixed blade cover 170 is moved utilizing the change in behavior of the pressing of the platen roller 111 and the thermal line head 112 when the opening/closing part 101B is closed as well as the release from the pressing of the platen roller 111 of the thermal line head 112 when the opening/closing part 101B is open, based on the energizing force of the coil springs 115. With this arrangement, the movement of the fixed blade cover 170 can be smoothly performed in conjunction with the opening and closing of the opening/closing part 101B.

Further, in particular, according to this embodiment, the head unit HU, which integrates the heat sink 114 for cooling the generated heat in the thermal line head 112, the thermal line head 112, and the fixed blade cover 170, is supported in a relatively displaceable manner with respect to the unit housing 190. With this arrangement, it is possible to simplify the configuration and decrease the number of parts compared to a case where the structure that supports the thermal line head 112 in a relatively moveable manner and the structure that supports the fixed blade cover 170 in a relatively moveable manner are separately constructed.

Further, according to this embodiment, the front side of the outer edge part of the discharging exit 107 is provided to the fixed cover part 101A, while the rear side thereof is provided to the opening/closing part 101B. In this case, the section of the discharging exit 107 that is on the opening/closing part 101B side separates from the section on the fixed cover part 101A side when the opening/closing part 101B is opened. The fixed blade 160, since it is fixed to the fixed cover part 101A near the discharging exit 107, is reliably exposed toward the operator in a state in which the section on the opening/closing part 101B side is separated as described above. Accordingly, in this case, in particular, the fixed blade cover 170 covers the blade edge of the fixed blade 160 when the opening/closing part 101B is in an open state as described above, particularly increasing the effect of increased safety.

What is claimed is:

1. A printer comprising:

a housing configured to constitute a printer contour and configured to comprise a fixed part and an opening/closing part that is openably and closeably connected to said fixed part;

a storage part configured to store a roll around which is wound a print-receiving medium and is open and close by said opening/closing part;

a feeding roller that is supported rotatably with respect to said opening/closing part and is configured to feed said print-receiving medium supplied from said roll stored in said storage part;

a head unit that is capable of rocking and is arranged in a rocking space disposed on said fixed part;

an energizing member being configured so that an end of one side of the energizing member is fixed to said fixed part and being configured to cause an energizing force toward the other side to act upon said head unit positioned in said rocking space;

a discharging exit configured to discharge said print-receiving medium on which printing was performed by said head unit to outside said housing; and a fixed blade that is configured to cut said print-receiving medium discharged from said discharging exit, and is fixed to said fixed part so as to follow along an edge part of said discharging exit, and is mounted to said fixed part via horizontal support parts provided respectively on both ends of said fixed blade;

said head unit comprising;

a print head configured to perform desired printing on said print-receiving medium fed by said feeing roller;

a heat sink configured to cool generated heat in said print head; and a fixed blade cover that is positioned on the one side than said fixed blade and is configured to cover a blade edge of said fixed blade and has installation parts on both sides of said fixed blade cover, each of the installation parts having a leftward U shape part in which said horizontal support part of the fixed blade is configured to be inserted, said print head, said heat sink, and said fixed blade cover being included integrally in said head unit, and said installation parts of said fixed blade cover of said head unit are respectively fixed to said heat sink so that each of said horizontal support parts at both ends of said fixed blade is inserted in said leftward U shape part of said fixed blade cover.

2. The printer according to claim 1, wherein:

said fixed blade cover moves to the opening/closing part side by an action of the energizing force of said energizing member and covers said blade edge of said fixed blade when said opening/closing part changes to an open state and said print head separates from said feeding roller provided to said opening/closing part, and resists the energizing force of said energizing member, moves to a side opposite to the opening/closing part side, and does not cover said blade edge of said fixed blade when said opening/closing part changes to a closed state and said print head presses against said feeding roller provided to said opening/closing part.

3. The printer according to claim 1, wherein:

a first side section of an outer edge part of said discharging exit is provided to said fixed part of said housing;

a second side section of said outer edge part of said discharging exit is provided to said opening/closing part of said housing; and said fixed blade is fixed to said fixed part so as to follow along said first side section of said outer edge part of said discharging exit.

4. The printer according to claim 1, wherein:

each of said installation parts of said fixed blade cover of said head unit further has a vertical-piece-like portion, and said vertical-piece-like portion is fixed to said heat sink so that each of said horizontal support parts at both ends of said fixed blade is inserted in said leftward U shape part of said installation part of said fixed blade cover of said head unit.

* * * * *